US010815608B2

(12) United States Patent
Xu et al.

(10) Patent No.: US 10,815,608 B2
(45) Date of Patent: Oct. 27, 2020

(54) DRAINING ANTI-SIPHON DEVICE AND WASHING MACHINE PROVIDED WITH SAME

(71) Applicant: QINGDAO HAIER DRUM WASHING MACHINE CO., LTD., Qingdao, Shandong (CN)

(72) Inventors: Sheng Xu, Shandong (CN); Zhiqiang Zhao, Shangdong (CN); Xiuwen Peng, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 386 days.

(21) Appl. No.: 15/570,057

(22) PCT Filed: Apr. 15, 2016

(86) PCT No.: PCT/CN2016/079402
§ 371 (c)(1),
(2) Date: Oct. 27, 2017

(87) PCT Pub. No.: WO2016/173408
PCT Pub. Date: Nov. 3, 2016

(65) Prior Publication Data

US 2018/0127913 A1 May 10, 2018

(30) Foreign Application Priority Data

Apr. 30, 2015 (CN) ..... 2015 1 0217762

(51) Int. Cl.
*D06F 39/08* (2006.01)
*D06F 37/02* (2006.01)

(52) U.S. Cl.
CPC ..... *D06F 39/085* (2013.01); *D06F 37/02* (2013.01); *D06F 39/08* (2013.01); *D06F 39/083* (2013.01);
(Continued)

(58) Field of Classification Search
None
See application file for complete search history.

(56) References Cited

U.S. PATENT DOCUMENTS

2010/0212368 A1 8/2010 Kim et al.
2015/0040619 A1 2/2015 Kang et al.

FOREIGN PATENT DOCUMENTS

AU 466699 B2 11/1975
JP 55-115691 U 8/1980
(Continued)

OTHER PUBLICATIONS

International Search Report (PCT/ISA/210) dated Jul. 21, 2016, by the State Intellectual Property Office of the P.R. China as the International Searching Authority for International Application No. PCT/CN2016/079402.
(Continued)

*Primary Examiner* — Rita P Adhlakha
(74) *Attorney, Agent, or Firm* — Buchanan Ingersoll & Rooney PC

(57) ABSTRACT

A draining anti-siphon device has a water outlet pipe comprising a first water pipe and a second water pipe which are connected with each other, the pipe diameter of at least part of the second water pipe is larger than the pipe diameter of the first water pipe, one end of an air pipe is communicated with the second water pipe, and the communicating position of the air pipe and the second water pipe is located at a radial surface of the second water pipe, so that siphon reverse flow is prevented by means of a diameter changing structure of
(Continued)

the air pipe and the water outlet pipe. In a washing machine, the draining anti-siphon device is mounted on a draining hose, the air pipe of the draining anti-siphon device is communicated with the outer drum of the washing machine.

18 Claims, 4 Drawing Sheets

(52) U.S. Cl.
CPC ..... *D06F 39/087* (2013.01); *D06F 39/088* (2013.01); *D06F 2204/084* (2013.01)

(56) References Cited

FOREIGN PATENT DOCUMENTS

| | | | |
|---|---|---|---|
| JP | H04-088580 | U | 7/1992 |
| KR | 2000-0032394 | A | 6/2000 |
| KR | 2003-0092186 | A | 12/2003 |
| KR | 20070064015 | A | 6/2007 |
| KR | 20070082377 | A | 8/2007 |
| KR | 10-0792522 | B1 | 1/2008 |
| KR | 2010-0086621 | A | 8/2010 |

OTHER PUBLICATIONS

Written Opinion (PCT/ISA/237) dated Jul. 21, 2016, by the State Intellectual Property Office of the P.R. China as the International Searching Authority for International Application No. PCT/CN2016/079402.

Extended European Search Report dated Apr. 6, 2018, issued by the European Patent Office in corresponding European Application No. 16785839.8. (7 pages).

Office Action (Notice of Reasons for Refusal) dated Jun. 4, 2019, by the Japanese Patent Office in corresponding Japanese Patent Application No. 2017-556714 and English translation of the Office Action. (10 pages).

Office Action (Notification of Reason for Refusal) dated Nov. 30, 2018, by the Korean Patent Office in aorresponding Korean Patent Application No. 10-2017-7033873 and English translation of the Office Action. (13 pages).

DRAINING ANTI-SIPHON DEVICE AND WASHING MACHINE PROVIDED WITH SAME

TECHNICAL FIELD

The present disclosure relates to an anti-siphon device and a washing machine, in particular to a draining anti-siphon device and a washing machine provided with the draining anti-siphon device, belonging to the field of washing machine devices.

BACKGROUND ART

When the existing drum washing machine drains water, a drain pump operates; the drain pump stops at the end of drainage. Due to the presence of water in the draining pipe, the sudden stop of the drain pump causes a negative pressure inside the chamber of the drain pump, which easily causes the water in the draining pipe to flow back into the chamber of the drain pump. Once the consumer puts the end of the draining pipe into the water, a siphoning effect is easily caused to allow the draining pipe to siphon dirty water into the drain pump and cause the dirty water to enter the washing outer drum of the washing machine, thus easily contaminating washed clothes seriously and causing a bad user experience.

The present disclosure is provided in view of this.

SUMMARY OF THE DISCLOSURE

The technical problem to be solved by the present disclosure is to overcome the disadvantages of the prior art and provide a draining anti-siphon device and a washing machine provided with the draining anti-siphon device to prevent siphoning dirty water into the drain pump and further causing the dirty water to enter the outer drum of the washing machine.

In order to solve the above technical problem, the basic concept of the technical solution of the present disclosure is as follows:

A draining anti-siphon device comprises a water outlet pipe and an air pipe, wherein the water outlet pipe comprises a first water pipe and a second water pipe which are connected with each other, the pipe diameter of at least part of the second water pipe is larger than the pipe diameter of the first water pipe. One end of the air pipe is communicated with the second water pipe, and the communicating position of the air pipe and the second water pipe is located at a radial surface of the second water pipe.

Further, a bent part is formed at the joint of the first water pipe and the second water pipe so that an inclined angle of a certain degree is formed between the first water pipe and the second water pipe.

Further, the second water pipe is a stepped pipe with the pipe diameter increasing in sequence from the joint of the first water pipe and the second water pipe toward the end opening of the second water pipe. The first end opening of the air pipe is located at the stepped face of the second water pipe and the air pipe is communicated with the second water pipe, and the second end opening of the air pipe is arranged outside the water outlet pipe.

Further, the first end opening of the air pipe is located at a position on the stepped face of the second water pipe and close to the outer side of the bent part.

Further, the inner structure of the air pipe is of a diameter changing structure of a stepped hole, and the inner diameter of the air pipe close to the end opening of the second water pipe is the minimum.

Further, the air pipe is arranged in parallel with the second water pipe, the second water pipe has a thicker wall, and an axial through hole is formed in the wall of the second water pipe to function as an air pipe.

Further, an outer chamfer is arranged at a water inlet of the first water pipe, a boss is arranged on the outer wall of the first water pipe, a skirt is arranged on the second water pipe and is vertical to the central axis of the second water pipe, and a through hole is formed in the skirt to function as a fixing hole.

Further, the inclined angle between the first water pipe and the second water pipe is 90±5°.

A washing machine provided with the forgoing draining anti-siphon device having any of foregoing features comprises an inner drum, an outer drum, a housing and the draining anti-siphon device. The inner drum is mounted in the outer drum, the inner drum and the outer drum are mounted in the housing and the outer drum is suspended inside the housing through a spring. The draining anti-siphon device is fixed on the housing, one end opening of the air pipe of the draining anti-siphon device is communicated with the second water pipe of the draining anti-siphon device, the other end opening is communicated with the outer drum through a connecting pipe and the communicating position is located above the center of the outer drum. The end opening of the first water pipe of the draining anti-siphon device is connected with the drain pump through a draining hose, the drain pump is connected with the outer drum through a draining pipe. The end opening of the second water pipe of the draining anti-siphon device is connected to a draining hose arranged outside the housing of the washing machine; the air pipe of the draining anti-siphon device is arranged above the central axis of the second water pipe of the draining anti-siphon device.

Further, a skirt is formed on the outer peripheral surface of the second water pipe of the water outlet pipe of the draining anti-siphon device and is vertical to the central axis of the second water pipe. A through hole is formed in the skirt to function as a fixing hole, the draining anti-siphon device is fixed on the housing of the washing machine by allowing a screw to penetrate through the through hole. The inclined angle between the first water pipe and the second water pipe is 90±5°, the second water pipe is located above the first water pipe, and the draining anti-siphon device is higher than the center of the outer drum.

With adoption of the above technical solution, the present disclosure has the following beneficial effects as compared with the prior art.

A draining anti-siphon device according to the present disclosure comprises a water outlet pipe and an air pipe, wherein the water outlet pipe comprises a first water pipe and a second water pipe which are connected with each other, the pipe diameter of at least part of the second water pipe is larger than the pipe diameter of the first water pipe. One end of the air pipe is communicated with the second water pipe, and the communicating position of the air pipe and the second water pipe is located at a radial surface of the second water pipe, so that siphon reverse flow is prevented by means of a diameter changing structure of the air pipe and the water outlet pipe. By means of the structure, the water pressure at the air pipe is small, which effectively prevents dirty water flowing back to a washing outer drum through the air pipe due to water pressure during drainage. The present disclosure provides a washing machine which is provided with a draining anti-siphon device, the space of the bent part of the housing of the washing machine is effectively used to arrange a draining hose. In addition, the fixing position of the draining anti-siphon device which is fixed on the rear back plate of the housing of the washing machine is larger than the height of the center of the outer drum but less than the maximum height of the housing of the washing machine. At the end of drainage of the washing machine, the drain pump stops working, even if the end of the draining hose (i.e., the draining hose outside the washing machine) connected to the second water pipe of the draining anti-siphon device is immersed in water, once siphon backflow happens, an anti-siphon hose is communicated with the draining anti-siphon device and the outer drum and then air enters the draining anti-siphon device from the outer drum to invalid the siphon effect so that water will not flow back to the outer drum.

Specific embodiments of the present disclosure will now be described in further detail with reference to the accompanying drawings.

1. housing; 2. outer drum; 3. draining pipe; 4. drain pump; 5. draining hose; 6. water inlet pipe; 7. outer drum air vent; 8. draining anti-siphon device; 9. anti-siphon hose; 10. spring; 11. rubber shock pad; 12. shock damper; 13. skirt; 14. fixing hole; 15. second water pipe; 16. first water pipe; 17. air pipe; 18. boss; 19. chamfer; 20. large-diameter section; 21. small-diameter section.

DETAILED DESCRIPTION OF THE DISCLOSURE

Embodiment 1

Figure 3:
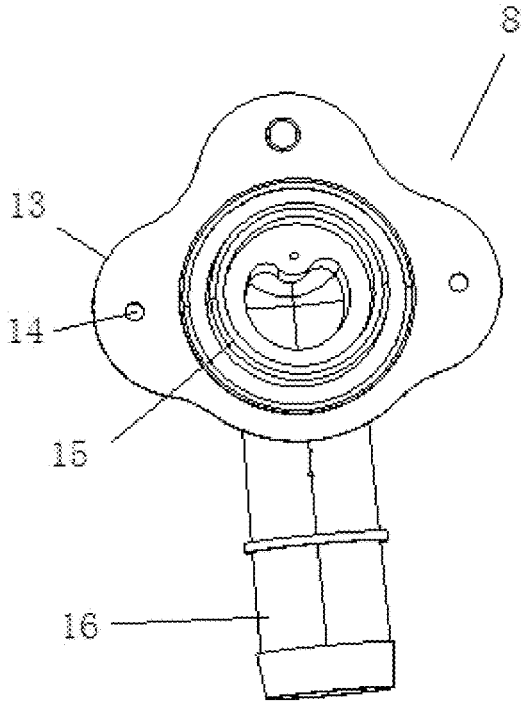
FIG. 3 shows a schematic diagram of the structure of the draining anti-siphon device according to Embodiment 1 of the present disclosure.
Figure 4:
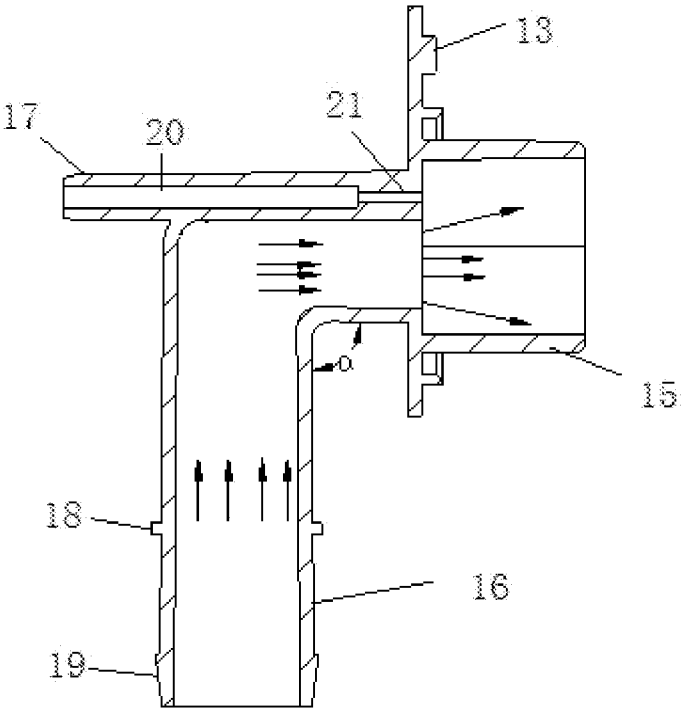
FIG. 4 shows a section view of the draining anti-siphon device according to Embodiment 1 of the present disclosure.
Figure 5:
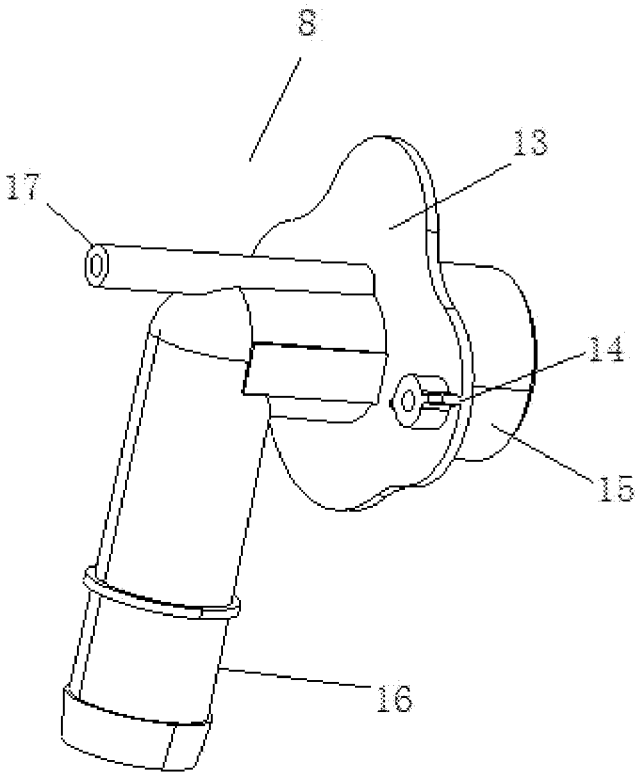
FIG. 5 shows a schematic diagram of the structure of the draining anti-siphon device according to Embodiment 2 of the present disclosure.

As shown in FIG. 3, FIG. 4 and FIG. 5, a draining anti-siphon device according to this embodiment comprises a water outlet pipe and an air pipe, wherein the water outlet pipe comprises a first water pipe 16 and a second water pipe 15 which are connected with each other. The pipe diameter of at least part of the second water pipe is larger than the pipe diameter of the first water pipe, one end of the air pipe is communicated with the second water pipe, and the communicating position of the air pipe and the second water pipe is located at a radial surface of the second water pipe.

A bent part is formed at the joint of the first water pipe 16 and the second water pipe 15 so that an inclined angle $\alpha$ of a certain degree is formed between the first water pipe 16 and the second water pipe 15. The range of the inclined angle $\alpha$ is $90\pm5°$. In this embodiment, $\alpha$ is $90°$.

The second water pipe 15 is a stepped pipe with the pipe diameter increasing in sequence from the joint of the first water pipe 16 and the second water pipe 15 toward the end opening of the second water pipe, the first end opening of the air pipe 17 is located at the stepped face of the second water pipe 15 and the air pipe is communicated with the second water pipe, and the second end opening of the air pipe is arranged outside the water outlet pipe.

The first end opening of the air pipe is located at a position on the stepped face of the second water pipe and having the largest distance from the inner inclined angle between the first water pipe and the second water pipe, that is, the first end opening of the air pipe is located at a position on the stepped face of the second water pipe and close to the outer side of the bent part. As shown in FIG. 4, when the draining anti-siphon device is arranged vertically and the second water pipe 15 is above the first water pipe 16, the air pipe is located at the top of the second water pipe.

Due to the bent structure of the first water pipe and the second water pipe, the fluid analysis shows that the uniform distribution of the water pressure is changed to small pressure at the side close to the air pipe, thus effectively avoiding reverse flow of water through the air pipe due to large water pressure.

Figure 2:
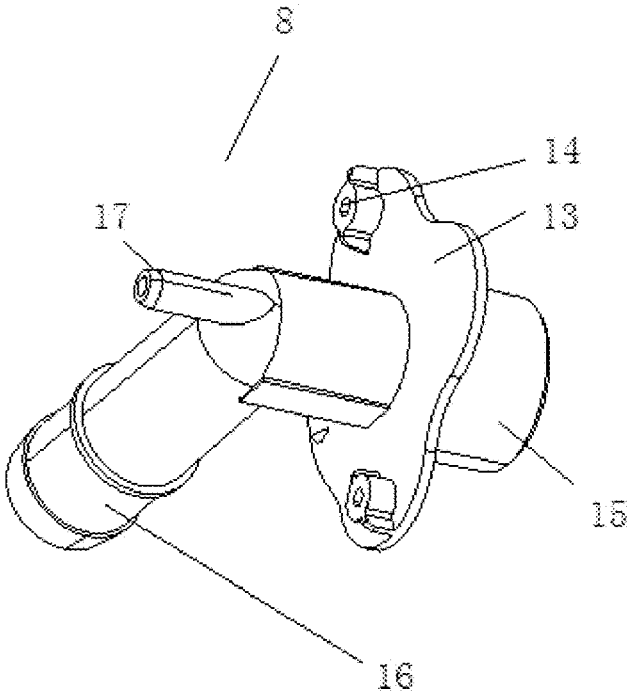
FIG. 2 shows a schematic diagram of the structure of the draining anti-siphon device according to Embodiment 1 of the present disclosure.

In this embodiment, as shown in FIG. 2, FIG. 3 and FIG. 4, the air pipe is arranged in parallel with the second water pipe, and the top of the second water pipe has a thicker wall, and an axial through hole is formed in the wall of the second water pipe to function as an air pipe. A part of the air pipe is enclosed in the second water pipe, one end opening of the air pipe is communicated with the second water pipe, the part of the air pipe which is close to this end opening is located in the second water pipe, and the part, far from this end opening, of the air pipe extends out of the water outlet pipe. In other embodiments, the air pipe may also be located outside the second water pipe, but connected to and communicated with the second water pipe through the joint.

As shown in FIG. 4, the air pipe 17, of which the inner diameter is a diameter changing structure of a stepped hole, is composed of a large-diameter section 20 and a small-diameter section 21. The inner diameter of the air pipe close to the end opening of the second water pipe is the minimum, the inner diameter of the air pipe far from the end opening of the second water pipe is large, and the length of the large-diameter section of the air pipe is larger than the length of the small-diameter section. Such a structure is easy to produce. With the structure, air can easily enter the second water pipe from the air pipe but the water inside the second water pipe can hardly enter the air pipe.

An outer chamfer 19 is arranged at the water inlet of the first water pipe 16, the outer wall of the first water pipe is provided with a boss 18, the second water pipe is provided with a skirt 13 which is vertical to the central axis of the second water pipe, and a through hole is formed in the skirt to function as a fixing hole 14. Thus, the device can be fixed to other equipment conveniently.

Embodiment 2

Figure 6:
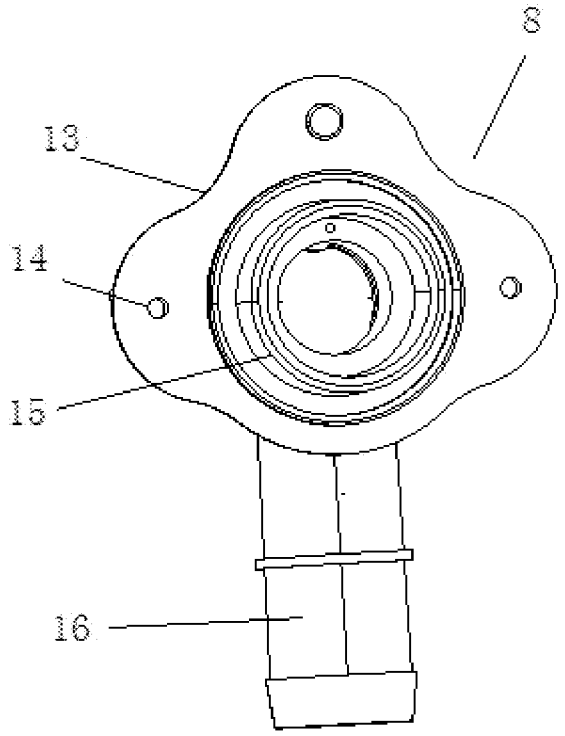
FIG. 6 shows a schematic diagram of the structure of the draining anti-siphon device according to Embodiment 2 of the present disclosure.
Figure 7:
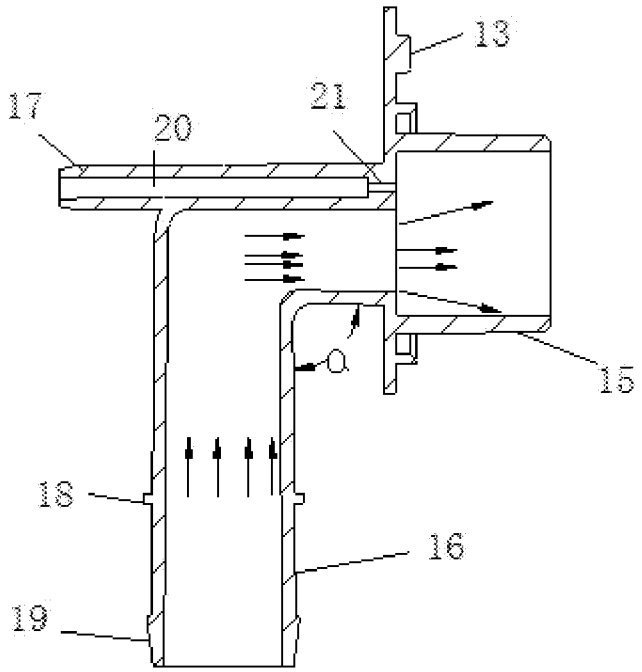
FIG. 7 shows a section view of the draining anti-siphon device according to Embodiment 2 of the present disclosure.

The difference between this embodiment and Embodiment 1 is that, as shown in FIG. 5, FIG. 6 and FIG. 7, the large-diameter section of the air pipe is longer and the small-diameter section is shorter, and the air pipe is further away from the axial direction of the center of the second water pipe and gets closer to the outside, thus not occupying the passageway of the second water pipe.

Embodiment 3

The washing machine according to this embodiment is provided with the draining anti-siphon device disclosed in Embodiment 1 or 2.

Figure 1:
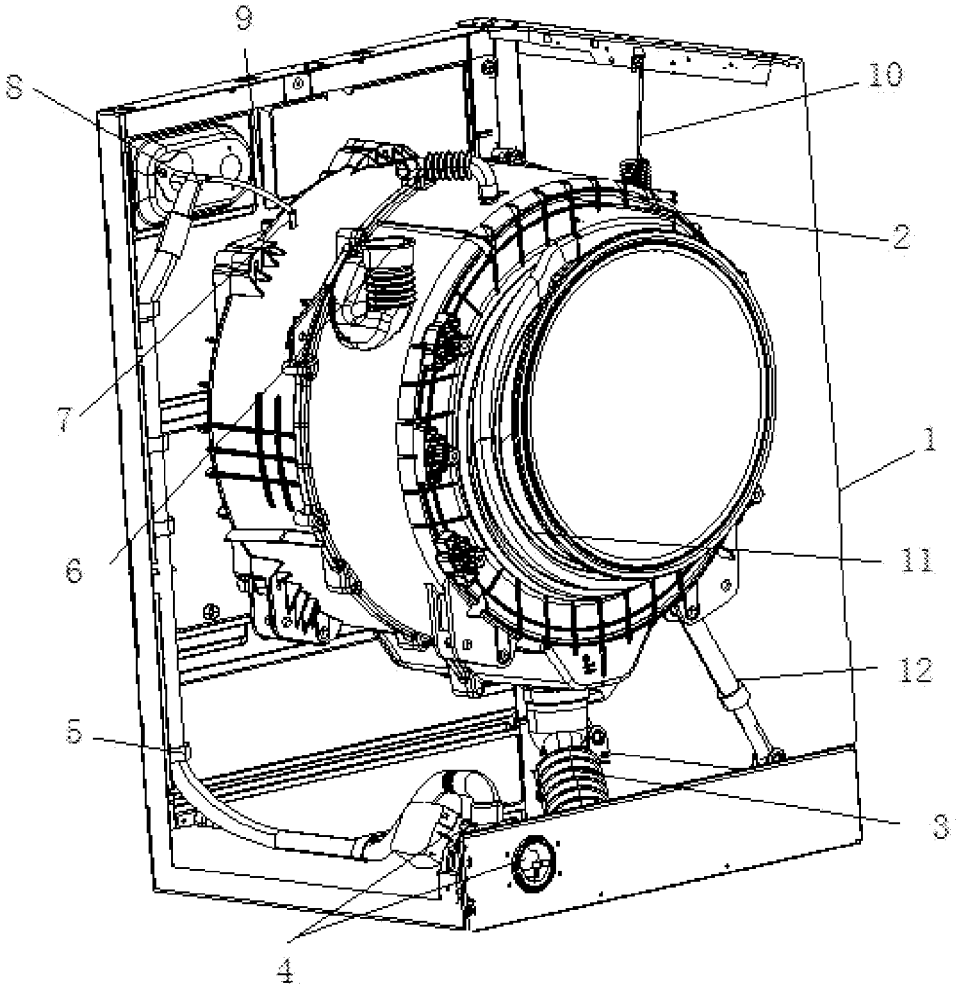
FIG. 1 shows a schematic diagram of the structure of a washing machine provided with a draining anti-siphon device according to Embodiment 1 of the present disclosure.

A washing machine provided with a draining anti-siphon device, as shown in FIG. 1, comprises an inner drum, an outer drum 2, a housing 1, and a draining anti-siphon device 8, wherein the inner drum is mounted in the outer drum, the outer drum is suspended in the housing through a spring. The upper end of the spring 10 is hung on the upper parts of panels on both sides of the housing of the washing machine, and the lower part of the outer drum is supported by a shock damper 12. The opening of the outer drum is connected to a rubber shock pad 11 and the rubber shock pad 11 is connected to the front panel of the housing. In order to more clearly illustrate the internal structure of the washing machine provided with a draining anti-siphon device according to the present disclosure, the front panel is removed and not shown in this figure.

The draining anti-siphon device 8 is fixed to the housing 1, as shown in FIG. 2, FIG. 3 and FIG. 4, and the anti-siphon device comprises a water outlet pipe and an air pipe 17, wherein the water outlet pipe comprises a first water pipe 16 and a second water pipe 15 which are connected with each other, and a bent part is formed at the joint of the first water pipe 16 and the second water pipe 15 so that an inclined angle $\alpha$ is formed between the first water pipe 16 and the second water pipe 15. The range of the inclined angle $\alpha$ is 90±5°. In this embodiment, this angle is 90°. The second water pipe 15 is a stepped pipe with the pipe diameter increasing in sequence from the joint of the first water pipe 16 and the second water pipe 15 toward the end opening of the second water pipe, the first end opening of the air pipe 17 is located at the stepped face of the second water pipe 15 and the air pipe is communicated with the second water pipe, and the second end opening of the air pipe is communicated with the outer drum through a connecting pipe and their communicating position is arranged above the center of the outer drum. In this embodiment, an outer drum air vent 7 is arranged at the top of the outer drum, and the connecting pipe is an anti-siphon hose 9 which is connected with the outer drum air vent 7.

The first end opening of the air pipe is located at a position on the stepped face of the second water pipe and having the largest distance from the inner inclined angle between the first water pipe and the second water pipe, that is, the first end opening of the air pipe is located at a position on the stepped face of the second water pipe and close to the outer side of the bent part. When the draining anti-siphon device 8 is mounted, the draining anti-siphon device is arranged vertically or in an inclined way, the second water pipe 15 is arranged above the first water pipe 16, and the air pipe is located at the top of the second water pipe or above the center of the second water pipe.

The second water pipe is of a diameter changing structure, the inner diameter of the first water pipe is less than the maximum inner diameter of the second water pipe, the inner diameter of the second water pipe changes from a small diameter to a large diameter in sequence from the joint of the joint of the second water pipe and the first water pipe toward the end opening of the second water pipe, thus easily generating a Venturi effect. In addition, the first end opening of the air pipe is located on the stepped face of the second water pipe 15, and the air pipe is communicated with the second water pipe to allow air to enter the second water pipe, instead of causing water to flow back into the outer drum through the air pipe.

Due to the bent structure of the first water pipe and the second water pipe, the fluid analysis shows that the uniform distribution of the water pressure is changed to small pressure at the side close to the air pipe, thus effectively avoiding reverse flow of water through the air pipe due to large water pressure.

In this embodiment, as shown in FIG. 2, FIG. 3 and FIG. 4, the air pipe is arranged in parallel with the second water pipe, and the top of the second water pipe has a thicker wall, and an axial through hole is formed in the wall of the second water pipe to function as an air pipe. A part of the air pipe is enclosed in the second water pipe, one end opening of the air pipe is communicated with the second water pipe, the part of the air pipe close to this end opening is located in the second water pipe, and the part, far from this end opening, of the air pipe extends out of the water outlet pipe. In other embodiments, the air pipe may also be located outside the second water pipe, but connected to and communicated with the second water pipe through the joint.

As shown in FIG. 4, the air pipe 17, of which the inner diameter is a diameter changing structure of a stepped hole, is composed of a large-diameter section 20 and a small-diameter section 21. The inner diameter of the air pipe close to the end opening of the second water pipe is the minimum, the inner diameter of the air pipe far from the end opening of the second water pipe is large, and the length of the large-diameter section of the air pipe is larger than the length of the small-diameter section. Such a structure is easy to produce. With the structure, air can easily enter the second water pipe from the air pipe but the water inside the second water pipe can hardly enter the air pipe.

By means of the bend structure of the water outlet pipe, the diameter changing structure of the second water pipe, the diameter changing structure of the air pipe and the structure that the first end opening of the air pipe is located at the position on the stepped face of the second water pipe and close to the outer side of the bend part, the water pressure at the air pipe is small, which effectively prevents dirty water flowing back to the washing outer drum through the air pipe due to water pressure during drainage.

An outer chamfer 19 is arranged at the end opening (i.e., the water inlet) of the first water pipe 16 of the draining anti-siphon device, a boss 18 is arranged on the outer wall of the first water pipe, the water inlet of the first water pipe is connected with the draining hose 5, and the draining hose inserts easily due to the arrangement of the chamfer, and the fixing of the insertion depth is facilitated by the boss structure. The other end of the draining hose 5 is connected to a drain pump 4, the drain pump 4 is connected to the outer drum 2 through a draining pipe 3, and the end opening of the second water pipe of the draining anti-siphon device is connected to a draining hose arranged outside the housing of the washing machine.

Further, a skirt 13 is arranged on the second water pipe and is vertical to the central axis of the second water pipe; and the skirt is used for fitting with the rear plate of the housing of the washing machine to increase the contact area of the second water pipe and the rear back plate. A through hole is formed in the skirt to function as a fixing hole 14, the draining anti-siphon device is fixed on the housing of the washing machine by allowing a screw to penetrate through the through hole.

Water inlet pipe 6 is formed at the upper part of the outer drum and is connected with a washing box. A feed valve feeds water into the washing box to drive detergent to enter the outer drum through the water inlet pipe 6.

The bottom of the outer drum is provided with a draining pipe 3 which is connected with the drain pump 4, and the drain pump is connected with the draining hose 5, so that water is discharged out of the washing machine through the draining anti-siphon device.

The present disclosure provides a washing machine which is provided with a draining anti-siphon device, the space of the bent part of the housing of the washing machine is effectively used to arrange a draining hose 5. In addition, the fixing position of the draining anti-siphon device which is fixed on the rear plate of the housing of the washing machine is larger than the height of the center of the outer drum but less than the maximum height of the housing of the washing machine, thus ensuring the consistency of the maximum height of the draining pipe of the washing machine in design. At the end of drainage of the washing machine, the drain pump stops working, even if the end of the draining hose connected to the second water pipe of the draining anti-siphon device (i.e., the draining hose outside the washing machine) is immersed in water, once siphon backflow happens, an anti-siphon hose is communicated with the draining anti-siphon device and the outer drum and then air enters the draining anti-siphon device from the outer drum to invalid the siphon effect so that water will not flow back to the outer drum.

The implementation solutions of the embodiments described above may be further combined or replaced, and the embodiments are merely illustrative of the preferred embodiments of the present disclosure and are not intended to limit the scope and scope of the present disclosure. Various changes and modifications made to the technical solutions of the present disclosure by those skilled in the art without departing from the design concept of the disclosure shall fall within the scope of the present disclosure.

The invention claimed is:

1. A draining anti-siphon device, comprising a water outlet pipe and an air pipe, wherein, the water outlet pipe comprises a first water pipe and a second water pipe which are connected with each other, a pipe diameter of at least part of the second water pipe is larger than a pipe diameter of the first water pipe, one end of the air pipe is configured to fluidly communicate with the second water pipe and a connecting position of the air pipe and the second water pipe is located at a radial surface of the second water pipe;

the second water pipe is a stepped pipe with pipe diameters increasing in sequence from a joint of the first water pipe and the second water pipe, the air pipe is provided in a pipe wall of the second water pipe from a stepped face of the second water pipe to an outside of the second water pipe, and the air pipe is arranged in parallel with the second water pipe, the one end of the air pipe is located on the stepped face of the second water pipe and the air pipe is configured to fluidly communicate with the second water pipe.

2. The draining anti-siphon device according to claim 1, wherein a bent part is formed at the joint of the first water pipe and the second water pipe so that an inclined angle is formed between the first water pipe and the second water pipe.

3. The draining anti-siphon device according to claim 2, wherein a first end opening of the air pipe is located at a position on the stepped face of the second water pipe and close to an outer side of the bent part.

4. The washing machine provided with the draining anti-siphon device defined in claim 3, comprising an inner drum, an outer drum, a housing, a drain pump and the draining anti-siphon device, wherein the inner drum is mounted in the outer drum, the inner drum and the outer drum is mounted in the housing and the outer drum is suspended inside the housing through a spring, the draining anti-siphon device is fixed on the housing, the first end opening of the air pipe of the draining anti-siphon device is configured to fluidly communicate with the second water pipe of the draining anti-siphon device, a second end opening of the air pipe is configured to fluidly communicate with the outer drum through a connecting pipe and a connecting position is located above a center of the outer drum, an end opening of the first water pipe of the draining anti-siphon device is connected with the drain pump through a draining hose, the drain pump is connected with the outer drum through a draining pipe, an end opening of the second water pipe of the draining anti-siphon device is connected to a draining hose arranged outside the housing of the washing machine;

the air pipe of the draining anti-siphon device is arranged above a central axis of the second water pipe of the draining anti-siphon device.

5. The draining anti-siphon device according to claim 2, wherein the inclined angle between the first water pipe and the second water pipe is 90°±5°.

6. The draining anti-siphon device according to claim 2, wherein a first end opening of the air pipe is located at a stepped face of the second water pipe, and a second end opening of the air pipe is arranged outside the water outlet pipe.

7. The draining anti-siphon device according to claim 2, wherein an inner structure of the air pipe is of diameters changing structure of a stepped hole, and an inner diameter of the air pipe close to an end opening of the second water pipe is the minimum.

8. The draining anti-siphon device according to claim 2, wherein an outer chamfer is arranged at a water inlet of the first water pipe, a boss is arranged on an outer wall of the first water pipe, a skirt is arranged on the second water pipe and is vertical to a central axis of the second water pipe, and a through hole is formed in the skirt to function as a fixing hole.

9. The washing machine provided with the draining anti-siphon device defined in claim 2, comprising an inner drum, an outer drum, a housing, a drain pump and the draining anti-siphon device, wherein the inner drum is mounted in the outer drum, the inner drum and the outer drum is mounted in the housing and the outer drum is suspended inside the housing through a spring, the draining anti-siphon device is fixed on the housing, a first end opening of the air pipe of the draining anti-siphon device is configured to fluidly communicate with the second water pipe of the draining anti-siphon device, a second end opening of the air pipe is configured to fluidly communicate with the outer drum through a connecting pipe and a connecting position is located above a center of the outer drum, an end opening of the first water pipe of the draining anti-siphon device is connected with the drain pump through a draining hose, the drain pump is connected with the outer drum through a draining pipe, an end opening of the second water pipe of the draining anti-siphon device is connected to a draining hose arranged outside the housing of the washing machine;

the air pipe of the draining anti-siphon device is arranged above a central axis of the second water pipe of the draining anti-siphon device.

10. The draining anti-siphon device according to claim 1, wherein a first end opening of the air pipe is located at the stepped face of the second water pipe, and a second end opening of the air pipe is arranged outside the water outlet pipe.

11. The washing machine provided with the draining anti-siphon device defined in claim 10, comprising an inner drum, an outer drum, a housing, a drain pump and the draining anti-siphon device, wherein the inner drum is mounted in the outer drum, the inner drum and the outer drum is mounted in the housing and the outer drum is suspended inside the housing through a spring, the draining anti-siphon device is fixed on the housing, the first end opening of the air pipe of the draining anti-siphon device is configured to fluidly communicate with the second water pipe of the draining anti-siphon device, the second end opening of the air pipe is configured to fluidly communicate with the outer drum through a connecting pipe and a connecting position is located above a center of the outer drum, an end opening of the first water pipe of the draining anti-siphon device is connected with the drain pump through a draining hose, the drain pump is connected with the outer drum through a draining pipe, an end opening of the second water pipe of the draining anti-siphon device is connected to a draining hose arranged outside the housing of the washing machine;

the air pipe of the draining anti-siphon device is arranged above a central axis of the second water pipe of the draining anti-siphon device.

12. The draining anti-siphon device according to claim 1, wherein an inner structure of the air pipe is of diameters changing structure of a stepped hole, and an inner diameter of the air pipe close to an end opening of the second water pipe is the minimum.

13. The draining anti-siphon device according to claim 12, wherein the second water pipe has a thicker wall than a wall of the air pipe, and an axial through hole is formed in a wall of the second water pipe to function as the air pipe.

14. The draining anti-siphon device according to claim 13, wherein the inclined angle between the first water pipe and the second water pipe is 90°±5°.

15. The washing machine provided with the draining anti-siphon device defined in claim 12, comprising an inner drum, an outer drum, a housing, a drain pump and the draining anti-siphon device, wherein the inner drum is mounted in the outer drum, the inner drum and the outer drum is mounted in the housing and the outer drum is suspended inside the housing through a spring, the draining anti-siphon device is fixed on the housing, a first end opening of the air pipe of the draining anti-siphon device is configured to fluidly communicate with the second water pipe of the draining anti-siphon device, a second end opening of the air pipe is configured to fluidly communicate with the outer drum through a connecting pipe and a connecting position is located above a center of the outer drum, an end opening of the first water pipe of the draining anti-siphon device is connected with the drain pump through a draining hose, the drain pump is connected with the outer drum through a draining pipe, an end opening of the second water pipe of the draining anti-siphon device is connected to a draining hose arranged outside the housing of the washing machine;

the air pipe of the draining anti-siphon device is arranged above a central axis of the second water pipe of the draining anti-siphon device.

16. The draining anti-siphon device according to claim 1, wherein an outer chamfer is arranged at a water inlet of the first water pipe, a boss is arranged on an outer wall of the first water pipe, a skirt is arranged on the second water pipe and is vertical to a central axis of the second water pipe, and a through hole is formed in the skirt to function as a fixing hole.

17. A washing machine provided with the draining anti-siphon device defined in claim 1, comprising an inner drum, an outer drum, a housing, a drain pump and the draining anti-siphon device, wherein the inner drum is mounted in the outer drum, the inner drum and the outer drum is mounted in the housing and the outer drum is suspended inside the housing through a spring, the draining anti-siphon device is fixed on the housing, a first end opening of the air pipe of the draining anti-siphon device is configured to fluidly communicate with the second water pipe of the draining anti-siphon device, a second end opening of the air pipe is configured to fluidly communicate with the outer drum through a connecting pipe and a connecting position is located above a center of the outer drum, an end opening of the first water pipe of the draining anti-siphon device is connected with the drain pump through a draining hose, the drain pump is connected with the outer drum through a draining pipe, an end opening of the second water pipe of the draining anti-siphon device is connected to a draining hose arranged outside the housing of the washing machine;

the air pipe of the draining anti-siphon device is arranged above a central axis of the second water pipe of the draining anti-siphon device.

18. The washing machine provided with the draining anti-siphon device according to claim 17, wherein a skirt is formed on an outer peripheral surface of the second water pipe of the water outlet pipe of the draining anti-siphon device and is vertical to the central axis of the second water pipe, a through hole is formed in the skirt to function as a fixing hole, the draining anti-siphon device is fixed on the housing of the washing machine by allowing a screw to penetrate through the through hole, an inclined angle between the first water pipe and the second water pipe is 90°±5°, the second water pipe is located above the first water pipe, and the draining anti-siphon device is higher than the center of the outer drum.

* * * * *